US005614699A

United States Patent [19]

Yashiro et al.

[11] Patent Number: 5,614,699

[45] Date of Patent: Mar. 25, 1997

[54] AUTOMOBILE EXHAUST NOISE SUPPRESSOR

[75] Inventors: Haruki Yashiro, Fujisawa; Akira Sasaki, Yokosuka; Kazushige Maeda, Zushi, all of Japan

[73] Assignee: Nissan Motor Co., Ltd., Yokohama, Japan

[21] Appl. No.: 429,091

[22] Filed: Apr. 26, 1995

[30] Foreign Application Priority Data

May 9, 1994 [JP] Japan ..... 6-095336
Oct. 12, 1994 [JP] Japan ..... 6-246355

[51] Int. Cl.[6] ..... F01N 1/00

[52] U.S. Cl. ..... 181/254; 181/265; 181/272

[58] Field of Search ..... 181/254, 265, 181/266, 272, 237, 282

[56] References Cited

U.S. PATENT DOCUMENTS 4,079,808 3/1978 Mizuno et al. ..... 181/237
4,484,659 11/1984 Buchwalder ..... 181/272 X
4,971,166 11/1990 Hase ..... 181/254

FOREIGN PATENT DOCUMENTS 57-13832 of 1982 Japan .
64-60709 3/1989 Japan .

*Primary Examiner*—Khanh Dang
*Attorney, Agent, or Firm*—Foley & Lardner

[57] ABSTRACT

A first and second noise suppressing mechanism are provided inside the muffler. Each mechanism is provided with a discharge pipe for discharging exhaust gas to outside the muffler. The first noise suppressing mechanism reduces exhaust noise in the low engine speed region. The second noise suppressing mechanism reduces noise in the medium and high engine speed regions. A valve is provided that connects the first noise suppressing mechanism and second noise suppressing mechanism according to the engine exhaust pressure. In the low speed region, the valve is closed and exhaust gas is discharged via the first noise suppressing mechanism where mainly low frequency noise is eliminated. In the medium and high speed regions, the valve is opened and exhaust gas is also discharged via the second noise suppressing mechanism where high frequency noise specific in these regions is also eliminated. Further, by the increased exhaust cross-sectional area, power drop due to increase of back pressure in the muffler in the high speed region, is prevented.

3 Claims, 18 Drawing Sheets

AUTOMOBILE EXHAUST NOISE SUPPRESSOR

FIELD OF THE INVENTION

This invention relates to a noise suppressor that reduces the noise produced in the exhaust pipe of an automobile engine.

BACKGROUND OF THE INVENTION order to obtain satisfactory noise suppression of an automobile engine over the entire range of engine speeds, noise suppressors have been designed that change the way in which they suppress noise according to the engine speed.

For example, Tokkai Sho 64-60709 published by the Japanese Patent Office in 1989, discloses a muffler provided with a first exhaust pipe suited to reducing exhaust noise in the low engine speed region, and a second exhaust pipe suited to reducing noise in the medium and high engine speed regions. A control valve is provided in the second exhaust pipe that opens only in the medium and high speed regions. In the low engine speed region, exhaust gas is discharged only via the first exhaust pipe. In the medium and high engine speed regions, the control valve opens so that the second exhaust pipe that is suited to reducing noise in the medium and high speed regions is brought into use together with the first pipe. Hence noise is reduced in these regions, while at the same time, the discharge cross-sectional area is increased in the medium and high speed regions where the exhaust gas flowrate is high, and energy losses due to increase of negative pressure are controlled.

However, the control valve in this exhaust device opens and closes via a mechanism consisting of a motor, wire and lever that are activated according to the engine speed. Its construction is therefore complex, and it is costly to manufacture.

Jikkai Sho 57-13832 published by the Japanese Patent Office in 1982, discloses a muffler for a two cycle engine wherein a control valve opens and closes, but according to a different construction that does not use the aforesaid mechanism. In this case, the muffler is divided into two compartments by means of a partition wall. These compartments are linked by two passageways in parallel, and a reed valve that closes one of these passageways under the exhaust pressure is installed adjacent to the upstream compartment.

As this device does not use mechanical force to open and close the valve, its construction is simple. In this case, however, the muffler has only one outlet passage, therefore large energy losses occur in the medium and high speed regions where the exhaust flowrate is high.

If the cross-section of the passage is increased in order to reduce losses, the expansion ratio of the aforesaid compartments becomes smaller so that there is less noise suppression effect. In this case, it is also difficult to effectively cancel the flow noise produced in the reed valve.

SUMMARY OF THE INVENTION

It is therefore an object of this invention to reduce exhaust noise and prevent energy losses without the use of a complex mechanism such as an actuator.

It is a further object of this invention to reduce exhaust gas flow noise specific to the high engine speed region.

It is still a further object of this invention to increase the durability of an opening and closing valve part used in a noise suppressor.

In order to achieve the above objects, this invention provides an exhaust noise suppressor for suppressing exhaust noise in an automobile engine. The suppressor comprises a muffler, an inlet tube for guiding engine exhaust in the muffler, a first noise suppressing mechanism connected to the inlet tube inside the muffler for reducing exhaust noise in the low engine speed region, a first discharge pipe for continuously discharging exhaust from the first noise suppressing mechanism, a second noise suppressing mechanism provided inside the muffler for reducing exhaust noise in an engine speed region higher than the low engine speed region, a passage mechanism connecting the first noise suppressing mechanism and second noise suppressing mechanism, a valve mechanism for opening and closing the passage mechanism according to an engine exhaust pressure, and a second discharge pipe for discharging exhaust from the second noise suppressing mechanism, According to an aspect of this invention, the passage mechanism comprises a plurality of passages while the valve mechanism comprises valves provided in each of these passages, and at least one of the valves is installed in a position facing the inlet tube.

According to another aspect of this invention, the first and second discharge pipes comprise a plurality of holes connecting the inside and outside of the pipes, a sound absorbing material covering these holes, and an envelope covering this sound absorbing material for preventing exhaust gas from leaking to the outside of the pipes.

According to yet another aspect of this invention, the valve mechanism comprises a reed valve.

According to yet another aspect of this invention, the second discharge pipe is inserted into the second noise suppressing mechanism. This pipe has one closed end and a plurality of holes connecting the inside and outside of the pipe being formed inside the second noise suppressing mechanism.

According to yet another aspect of this invention, the valve mechanism comprises a valve that opens and closes the passage mechanism, and a mechanism for pushing the valve toward its close position but allowing the valve to open when the exhaust pressure is above a predetermined value.

Preferably, the pushing mechanism is installed outside the muffler, and the valve mechanism further comprises a mechanism for transmitting a pushing force of the pushing mechanism to the valve.

Also preferably, the pushing mechanism comprises a mechanism for increasing a pushing force of the pushing mechanism at a predetermined rate as an opening of the valve increases, a mechanism for increasing the opening according to the exhaust pressure, and a mechanism for reducing the rate when the opening has exceeded a predetermined degree. It is preferably that this reducing mechanism gradually reduces the rate according to an increase of the valve opening. In order to materialize this gradual reduction of the rate, the valve mechanism comprises a rotation axis for rotating the valve so as to open and close the passage mechanism, and the pushing force increasing mechanism comprises a member in sliding contact with the valve. This member swings at a predetermined rate according to a rotation of the valve and pushes the valve toward its close position with a pushing force depending on an angle of its swing. The reducing mechanism comprises a predetermined curved surface formed on the valve, and the member gradually reduces the rate by shifting a sliding contact position along the curved surface according to an increase of an angle of the valve rotation.

According to vet another aspect of this invention, the reducing mechanism comprises a first sliding surface and second sliding surface having different angles formed on the valve. The member reduces the rate by shifting a sliding contact position on the valve from this first sliding surface to the second sliding surface according to an increase of an angle of the valve rotation.

According to yet another aspect of this invention, the valve mechanism comprises a rotation axis for rotating the valve so as to open and close the passage mechanism and a cam joined to the rotation axis outside the muffler. The pushing force increasing mechanism comprises a member in sliding contact with the cam. The member swings at a predetermined rate according to a rotation of the cam and pushes the cam toward a closing direction of the valve with a pushing force depending on an angle of swing of the member. The reducing means comprises a first sliding surface and second sliding surface having different angles formed on the cam, and the member reduces the rate by shifting a sliding contact position on the cam from the first sliding surface to the second sliding surface according to an increase of an angle of the cam rotation.

According to yet another aspect of this invention, the valve mechanism comprises a rotation axis for rotating the valve so as to open and close the passage mechanism. The pushing force increasing mechanism comprises a member in sliding contact with the valve. This member swings at a predetermined rate according to a rotation of the valve and pushes the valve toward its close position with a pushing force depending on an angle of swing of the member. The reducing mechanism comprises a mechanism for increasing a distance between a contact point of the member on the valve and the rotation axis according to an angle of the valve rotation. This distance increasing mechanism comprises, for example, a first contact point at a small distance from the rotation axis and a second contact point at a large distance from the axis. The first contact point is in contact with the member when an angle of the valve rotation is less than a predetermined value. The second contact point is in contact with the member when the valve rotation angle is greater than the predetermined value.

The details as well as other features and advantages of this invention are set forth in the remainder of the specification and are shown in the accompanying drawings.

DESCRIPTION OF THE PREFERRED EMBODIMENTS

Figure 1:
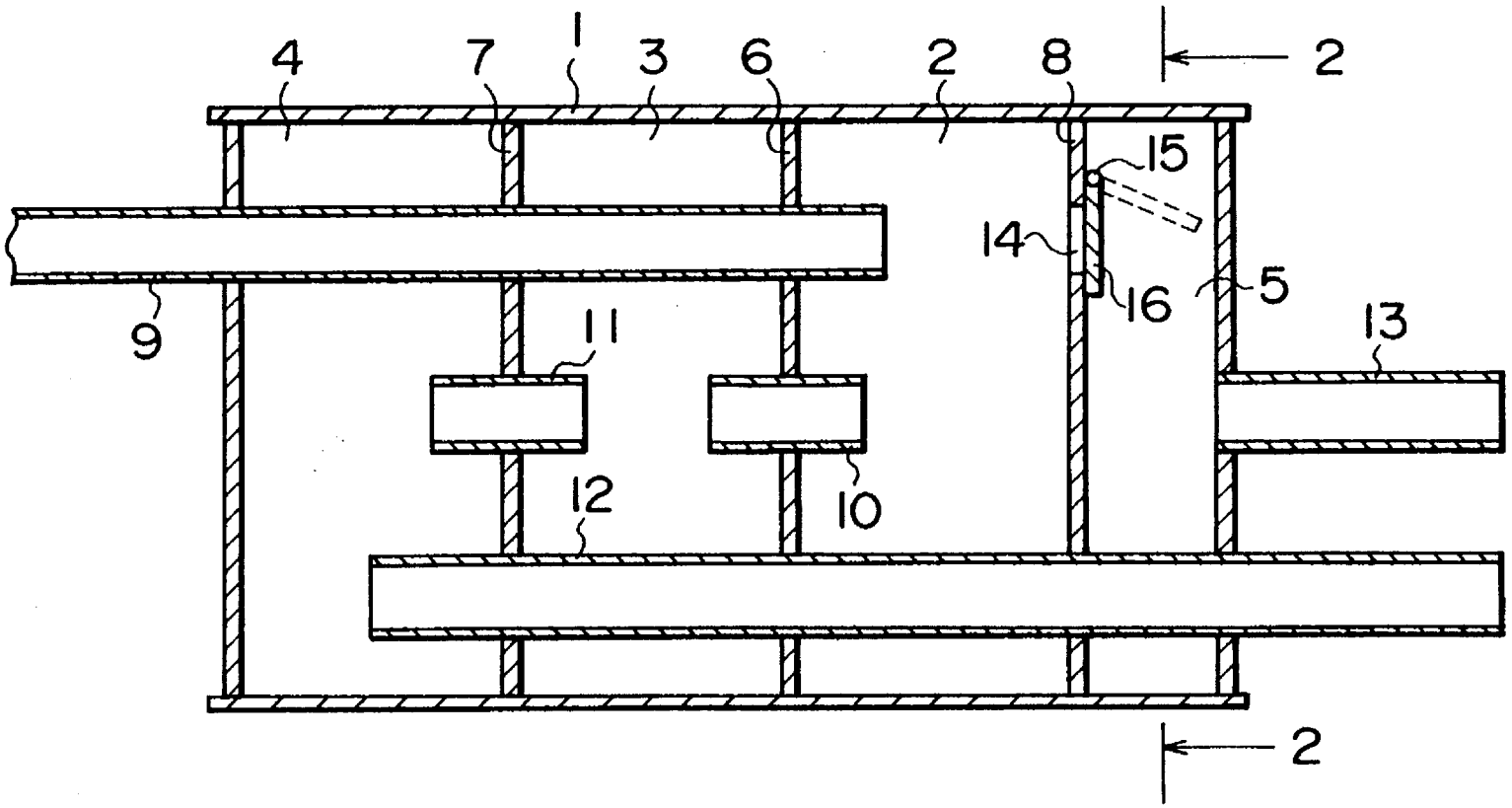
FIG. 1 is a vertical sectional view of a noise suppressor according to a first embodiment of this invention.

Referring to FIG. 1 of the drawings, a muffler 1 is connected to an engine exhaust inlet tube 9 and tail tubes 12, 13 for discharging exhaust gas that has passed through the muffler 1.

Figure 2:
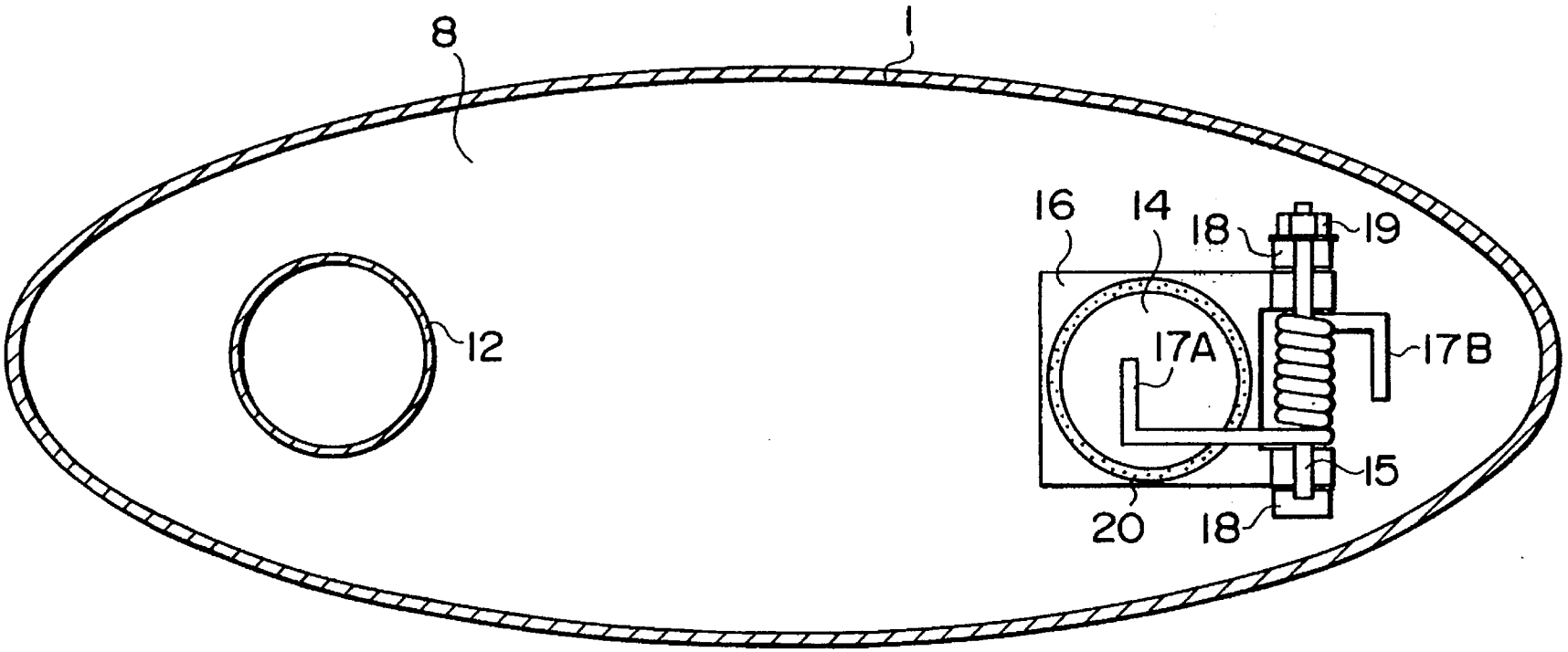
FIG. 2 is a cross-sectional view of the noise suppressor taken along a line 2—2 in FIG. 1.

The muffler 1 has an elliptical cross-section as shown in FIG. 2.

The interior of the muffler 1 is partitioned into chambers 4, 3, 2 and 5 by means of baffle plates 6, 7 and 8.

The inlet tube 9 passes through the chambers 4 and 3, and leads engine exhaust gas to the chamber 2.

The chambers 2 and 3 are connected together via a tube 10 that passes through the baffle plate 6. Likewise, the chambers 3 and 4 are connected via a tube 12 that passes through the baffle plate 7. The chambers 2, 3 and 4 each have a predetermined capacity required to reduce low frequency noise due to exhaust in the low engine speed region.

The tail tube 12 passes through the chambers 2,3 and 5, one end of the tube 12 being open to the chamber 4 and the other end being open to the atmosphere outside the muffler 1. The tail tube 12 is of such a diameter and length as is required to reduce exhaust noise in the low engine speed region.

The tail tube 12 constitutes a first exhaust pipe, while the chambers 2, 3 and 4 form a noise suppressing means.

The tail tube 13 is installed parallel to the tail tube 12, one end being open to the interior of the chamber 5 and the other end being open to the atmosphere outside the muffler 1. This tail tube constitutes a second exhaust pipe.

The chamber 5 has a predetermined capacity required to reduce high frequency noise due to exhaust in the medium and high engine speed regions. The chamber 5 constitutes a second noise suppressing means.

An opening 14 connecting the chambers 2 and 5 is formed in the baffle plate 8 in a position opposite to the inlet tube 9, and a valve 16 is provided in order to open and close the opening 14 according to the exhaust gas pressure.

Figure 3:
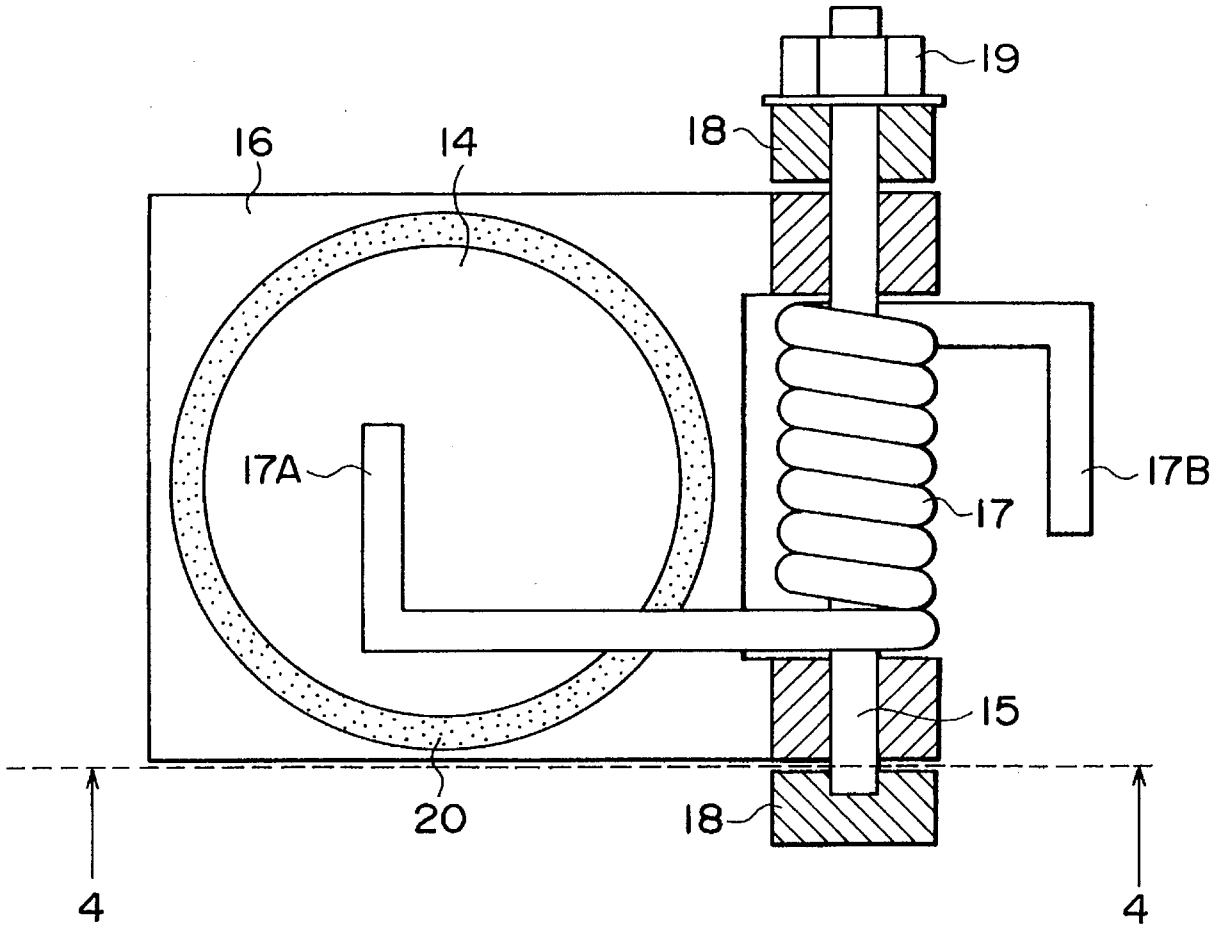
FIG. 3 is a rear view of a valve according to the first embodiment of this invention.
Figure 4:
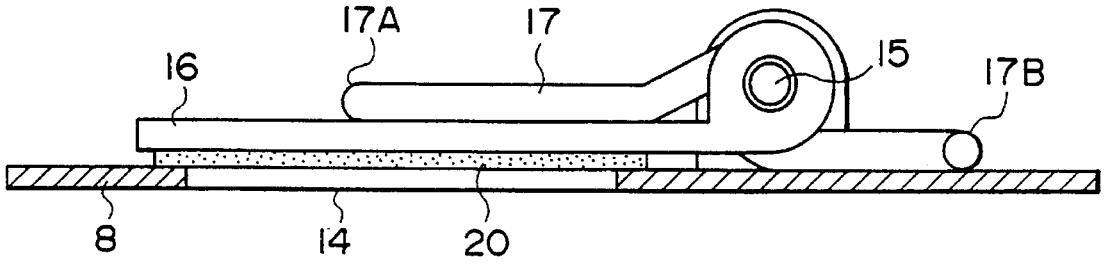
FIG. 4 is a side view of the valve.

As shown in FIGS. 2, 3 and 4, the valve 16 is formed in the shape of a flat member. One end of the valve 16 is joined to a shaft 15 supported via bearings 18 fixed to the baffle plate 8, the shaft 15 being supported such that it is free to rotate. A nut 19 is screwed on the upper end of the shaft 15, as shown in FIG. 2, so as to prevent the shaft 15 from falling off the bearings 18.

A coil spring 17 is fitted to the shaft 15. One end 17A of this spring 17 is bent into an L-shape, and is in contact with the rear face of the valve 16. The other end 17B is in contact with the baffle plate 8. The valve 16 is thereby constantly pushed in a direction tending to close the opening 14.

Cushioning material 20 is provided around the opening 14 so as to absorb the shock when the valve 16 closes.

The engine exhaust first flows into the chamber 2 via the inlet tube 9. As the exhaust pressure is low in the low engine speed region, the valve 16 which is pushed by the spring 17 does not open, so the exhaust in the chamber 2 flows into the chamber 3 via the tube 10, into the chamber 4 via the tube 11, and is then discharged to the atmosphere via the tail tube 12.

As the capacity of the chambers 2, 3 and 4 is suited to reducing low frequency noise in this low engine speed region, the pulsation component of the exhaust in synchronism with the engine speed, is attenuated by passing through the chambers 2,3 and 4.

Under these conditions, the exhaust passes only through the first noise suppressing means comprising the chambers 2, 3 and 4. In addition, the ratio of the cross-sectional area of the chambers 2, 3 and 4 to that of the tail tube 12 is set to a value suited to noise attenuation in the low engine speed region, so the capacity to reduce noise in this region is further enhanced.

When the engine speed increases, the pressure of the exhaust flowing from the inlet tube 9 to the chamber 2 increases, and when the speed reaches the medium and high regions, the valve 16 opens against the force of the spring 17 due to the increased pressure.

A part of the exhaust that has flowed into the muffler 1 therefore enters the chamber 5, and is discharged to the atmosphere from the tail tube 13.

The cross-sectional area of the passage discharging exhaust from the muffler 1 is therefore the sum of the cross-sectional area of the tail tube 12 and that of the tail tube 13, so the cross-section of the discharge pipe is larger than for the low speed region. Even in the medium and high speed regions where the exhaust flowrate is large, therefore, the back pressure does not become large, and there is no decrease of engine power due to energy losses. Further, as the cross-sectional area of the exhaust pipe is increased, the noise of the exhaust flow is suppressed to a low level.

The capacity of the chamber 5 is suited to reducing high frequency noise in the medium and high speed regions, so high frequency noise components in the medium and high speed regions are also attenuated. Satisfactory noise reduction performance is therefore obtained over the whole range of engine speeds without any associated decrease of engine power.

Figure 5:
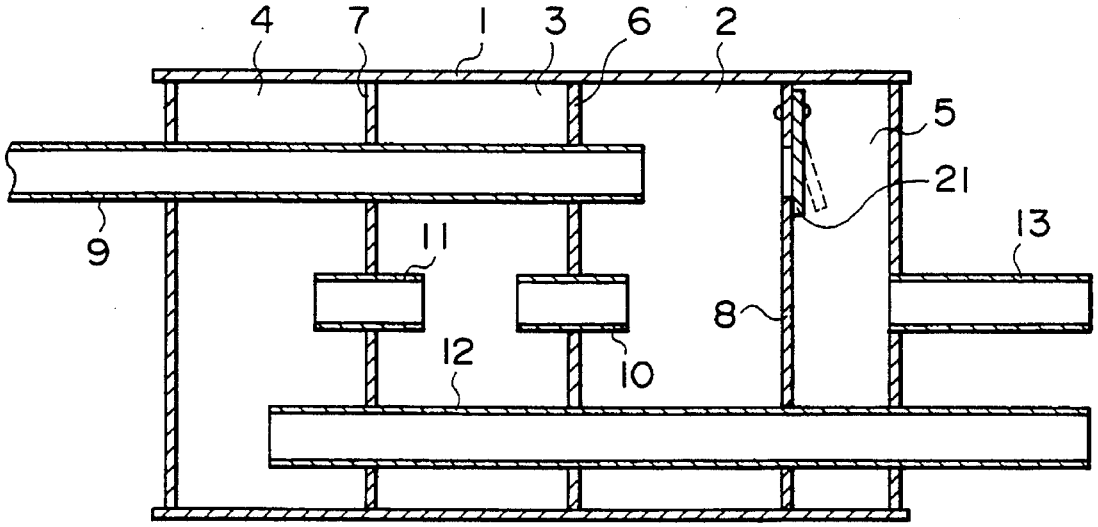
FIG. 5 is similar to FIG. 1, but showing a second embodiment of this invention.

FIG. 5 shows a second embodiment of this invention using a reed valve 21 instead of the valve 16 and spring 17. Use of a valve of this kind further simplifies the construction of noise suppressor.

Figure 6:
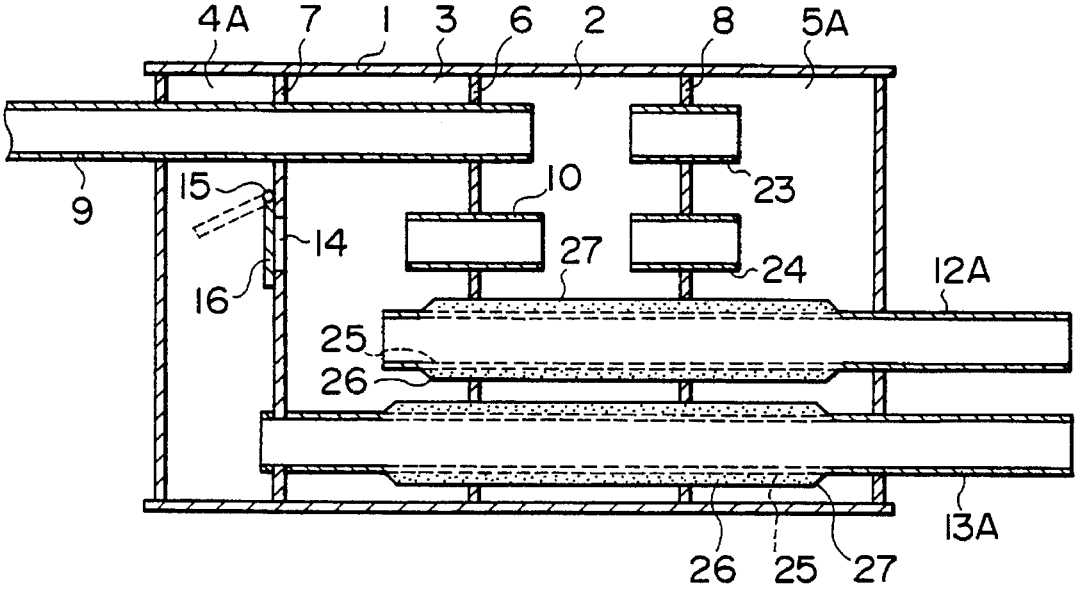
FIG. 6 is similar to FIG. 1, but showing a third embodiment of this invention.

FIG. 6 shows a third embodiment of this invention. Herein, the chamber 5 is replaced by a resonating chamber 5A, and the baffle plate 7 is provided with the valve 16. The resonating chamber 5A is permanently connected to the chamber 2 via two tubes 23,24 that pass through the baffle plate 8.

A tail tube 12A is connected to a chamber 3 and the atmosphere, while a tail tube 13A is connected to the chamber 4A and the atmosphere.

A large number of holes 25 are formed in those parts of the tail tubes 12A, 13A situated in the chambers 2, 3 and the resonating chamber 5A. Sound absorbing material 26 is wound around the outer circumference of the tubes. The outer circumference of this material 26 is moreover covered by an envelope 27 to prevent exhaust leaking from the tail tubes 12A, 13A.

In the low engine speed region, the noise of exhaust that has flowed into the muffler 1 from the inlet tube 9 is attenuated in the chamber 2, resonating chamber 5A and chamber 3, and further attenuated by the sound absorbing material 26 of the tail tube 12A. The exhaust is then discharged to the atmosphere outside the muffler 1.

In the medium and high engine speed regions, the valve 16 opens due to the exhaust pressure, and part of the exhaust that flowed into the chamber 3 flows into the chamber 4A. In the chamber 4A, essentially high frequency components are attenuated, and after noise is further attenuated by the sound absorbing material 26 of the tail tube 13, the exhaust is discharged to the atmosphere.

The resonating chamber 5A has the function of increasing attenuation of low frequency components. The sound absorbing material 26 acting via the holes 25 also efficiently attenuates the flow noise or pulsation noise of the exhaust passing through the tail tubes 12A. 13A. According to this embodiment, therefore, higher noise suppressing performance is obtained than in the case of the first embodiment. Moreover, as the tail tube 13A passes through the baffle plates 6 and 8, the rigidity of support of the tail tube 13 is also improved.

Figure 7:
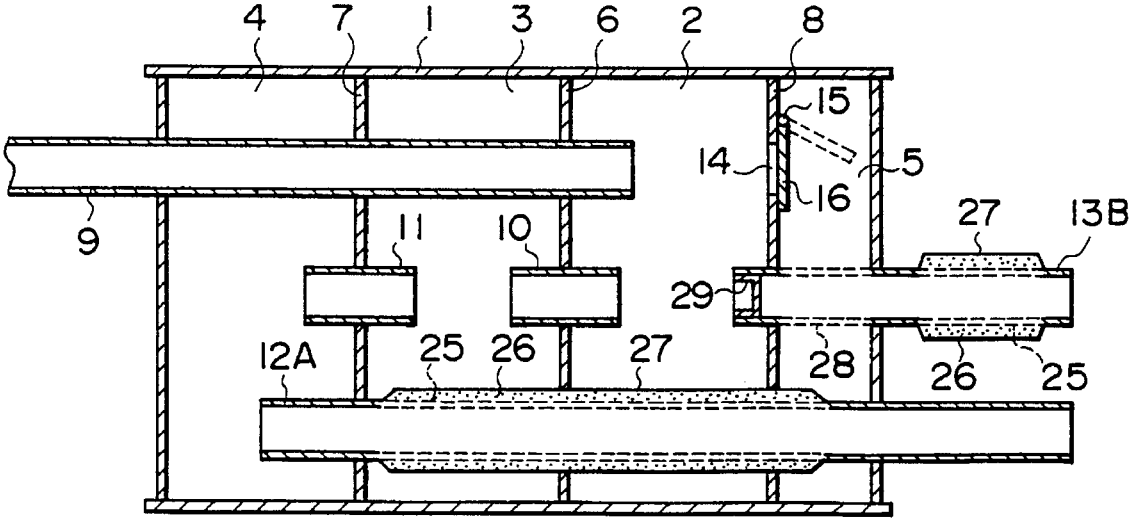
FIG. 7 is similar to FIG. 1, but showing a fourth embodiment of this invention.

FIG. 7 shows a fourth embodiment of this invention. According to this embodiment, the tail tube 12 of the first embodiment is modified to the same tail tube 12A as in the third embodiment, and the tail tube 13 is modified to a tail tube 13B passing through the chamber 5.

An end of the tube 13B is inserted in the chamber 2 and closed by a plug 29. A large number of holes 28 are provided in that part of the tail tube 13B situated in the chamber 5. Holes 25 are also provided in that part of the tail tube 13B protruding outside the muffler 1, the sound absorbing material 26 is wound on the tube, and the material 26 is covered by the envelope 27 to prevent exhaust from leaking.

In the medium and high engine speed regions, the exhaust opens the valve 16, flows into the chamber 5 and then flows into the tail tube 13B, the flow being regulated by the holes 28. This regulation suppresses the noise produced by the turbulent flow.

As the attenuating effect of the absorbing material 26 reduces the noise via the holes 25, a higher noise suppression performance is obtained than in the case of the first embodiment.

Figure 8:
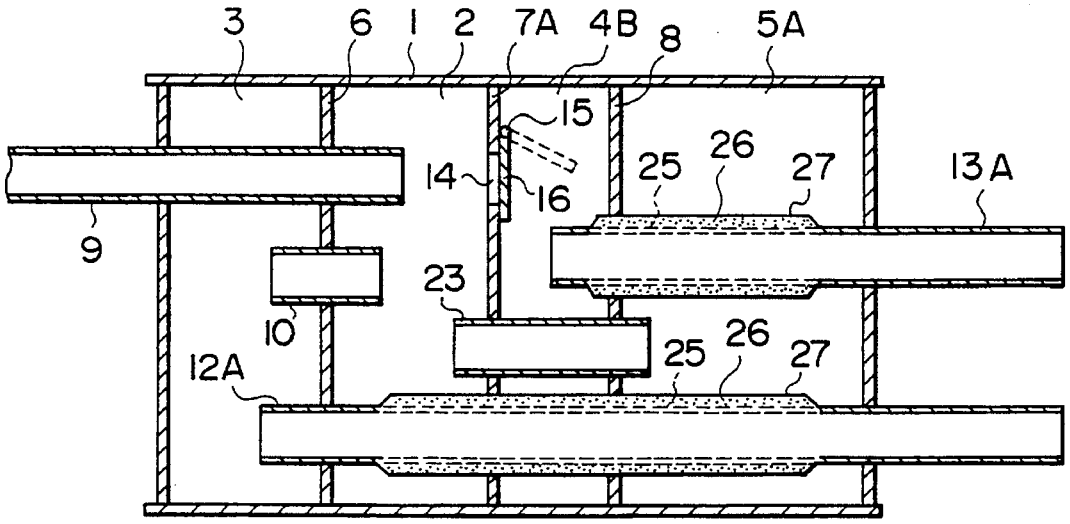
FIG. 8 is similar to FIG. 1, but showing a fifth embodiment of this invention.

FIG. 8 shows a fifth embodiment of this invention. According to this embodiment, instead of the chamber 4A of the third embodiment, a chamber 4B is provided between the chamber 2 and resonating chamber 5A, and the valve 16 is provided in a baffle plate 7A that partitions the chamber 2 and 4B. The chamber 2 and resonating chamber 5A are joined by a tube 23 that passes through the chamber 4B.

According to this embodiment, the same effect is obtained as in the case of the third embodiment, however as the chamber 4B is installed effectively in the middle of the muffler 1, there is a greater freedom of design regarding the chambers 2, 3 and resonating chamber 5.

Figure 9:
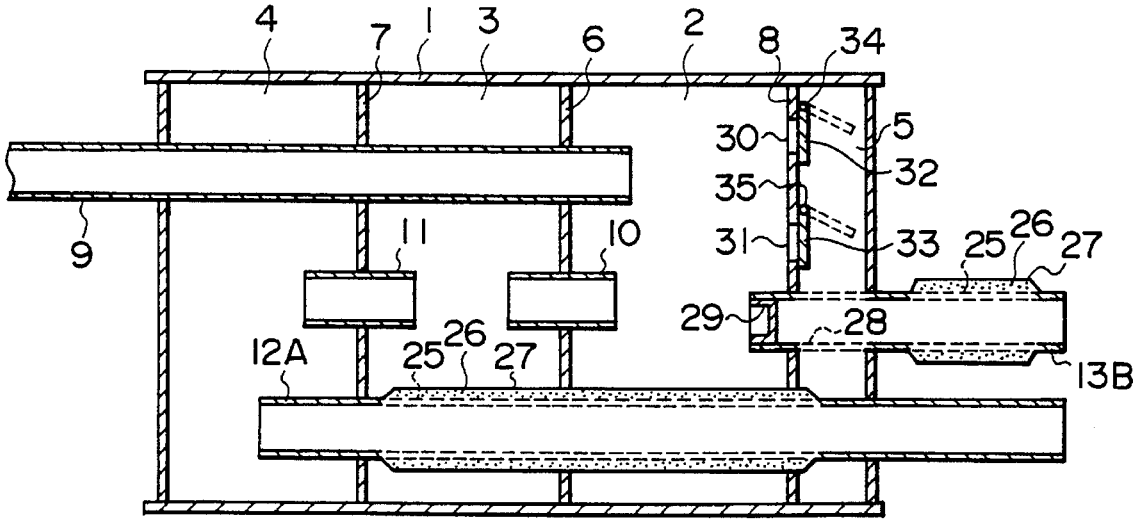
FIG. 9 is similar to FIG. 1, but showing a sixth embodiment of this invention.

FIG. 9 shows a sixth embodiment of this invention. According to this embodiment, the opening 14 and valve 16 of the fourth embodiment are replaced by a plurality of openings 30,31 and valves 32,33.

By providing a plurally of openings and valves, the valves can be made compact and their radius of swing can be reduced. The dimensions of the chamber 5 may therefore be set with less restriction due to valve operating space requirements, and good conditions are realized for making the chamber 5 and muffler 1 compact.

Figure 10:
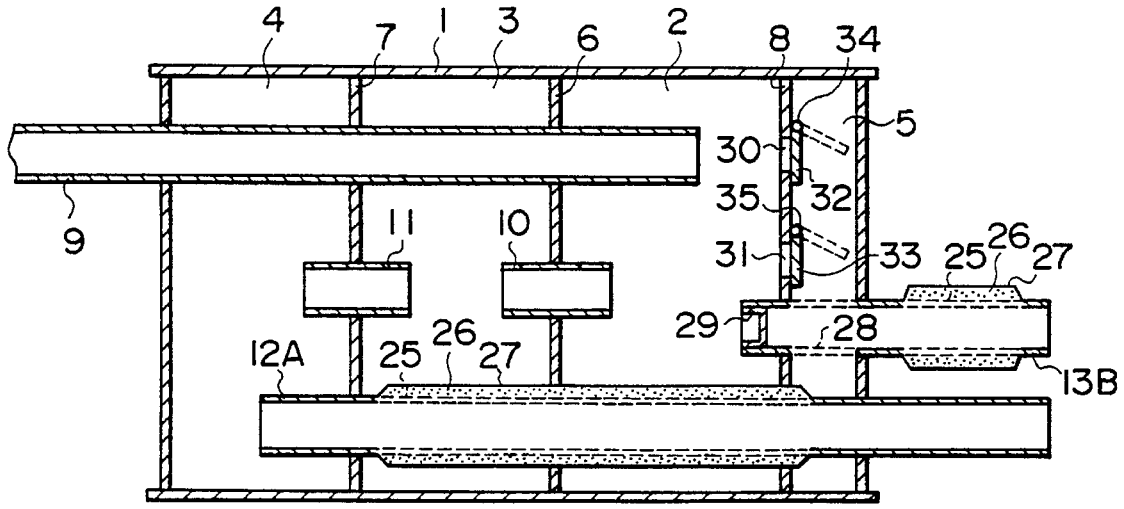
FIG. 10 is similar to FIG. 1, but showing a seventh embodiment of this invention.

FIG. 10 shows a seventh embodiment of this invention. According to this embodiment, the holes 30 and valves 32 of the sixth embodiment are disposed in front of the opening of the inlet tube 9.

According to this device, the valve 32 opens due to the pressure exerted directly by the exhaust discharged by the inlet tube 9, while the valve 33 opens due to the pressure of the whole chamber 2.

The valve 32 opens in the medium engine speed region, while the valve 33 opens in the high engine speed region. The response to engine speed variations is therefore made smoother by making the times at which the valves 32, 33 open, different.

Figure 11:
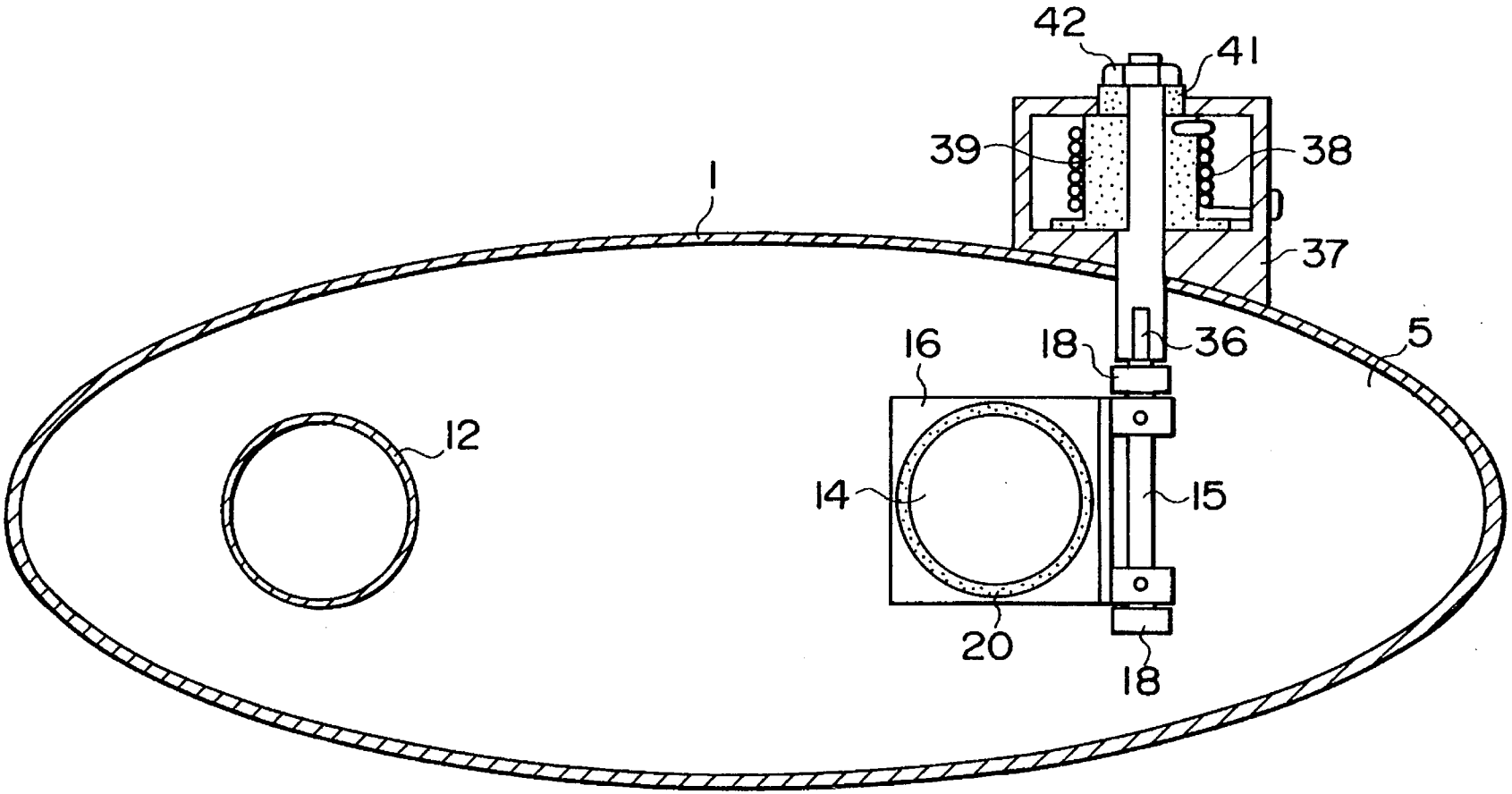
FIG. 11 is similar to FIG. 2, but showing an eighth embodiment of this invention.

FIG. 11 shows an eighth embodiment of this invention. Herein, instead of the spring 17 of the first embodiment, a spring 38 is provided outside the muffler 1. A case 37 housing the spring 38 is fixed on the outer circumference of the muffler 1, and a shaft 36 that projects inside the muffler 1 from the case 37 is joined to the end of the shaft 15.

A collar 39 fits over the shaft 36 in the case 37, and is fixed to the shaft 36 by means of a spacer 41 and a nut 42. The spring 38 fits over the outer circumference of the collar 39. One end of the spring 38 is attached to the case 37, the other end being joined to the collar 39. The spring 38 therefore pushes the valve 16 in a direction tending to close it via the collar 39, shaft 36 and shaft 15.

As the spring 38 disposed outside the muffler 1 does not come into direct contact with the exhaust, there is less deterioration due to heat and corrosion than in the case where it is installed in the muffler 1.

Figure 12:
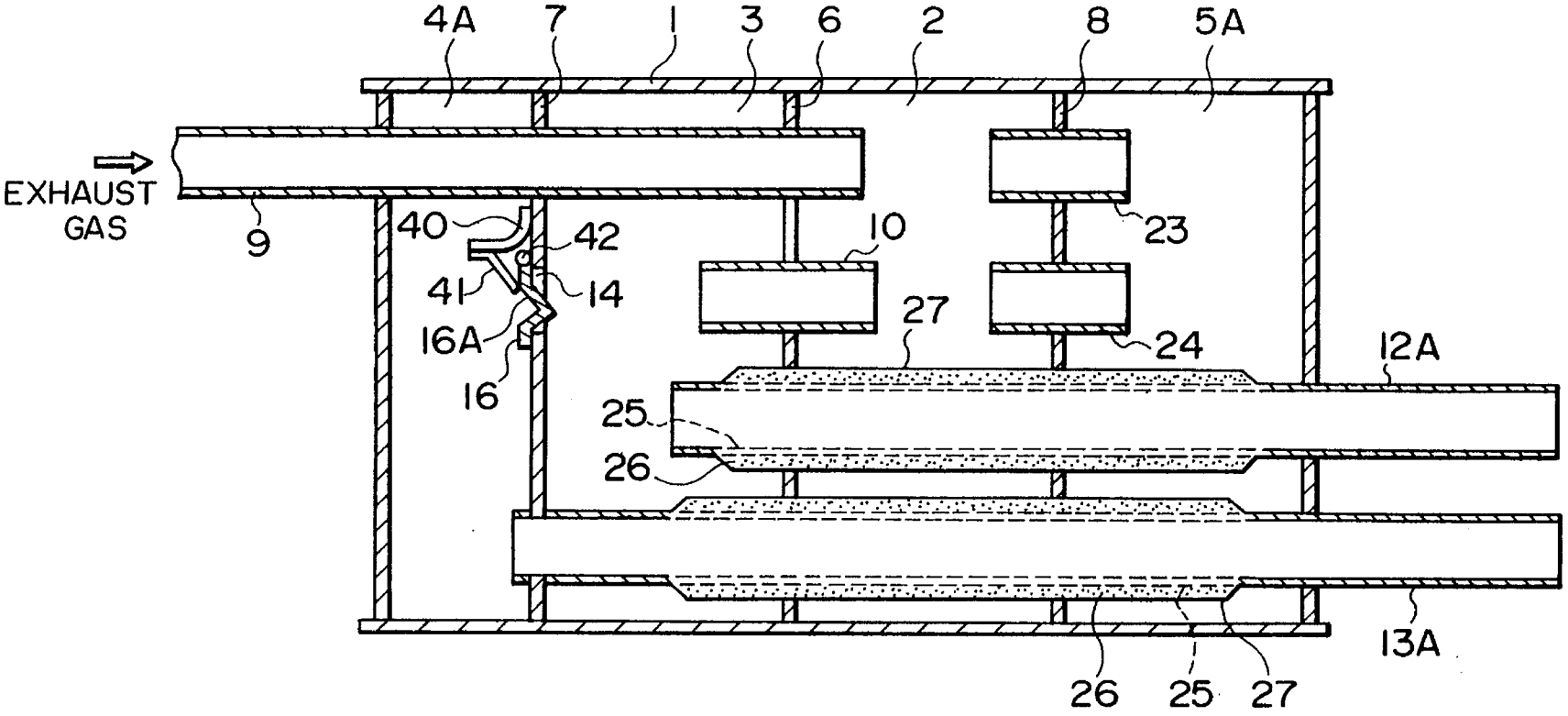
FIG. 12 is similar to FIG. 1, but showing a ninth embodiment of this invention.
Figure 13:
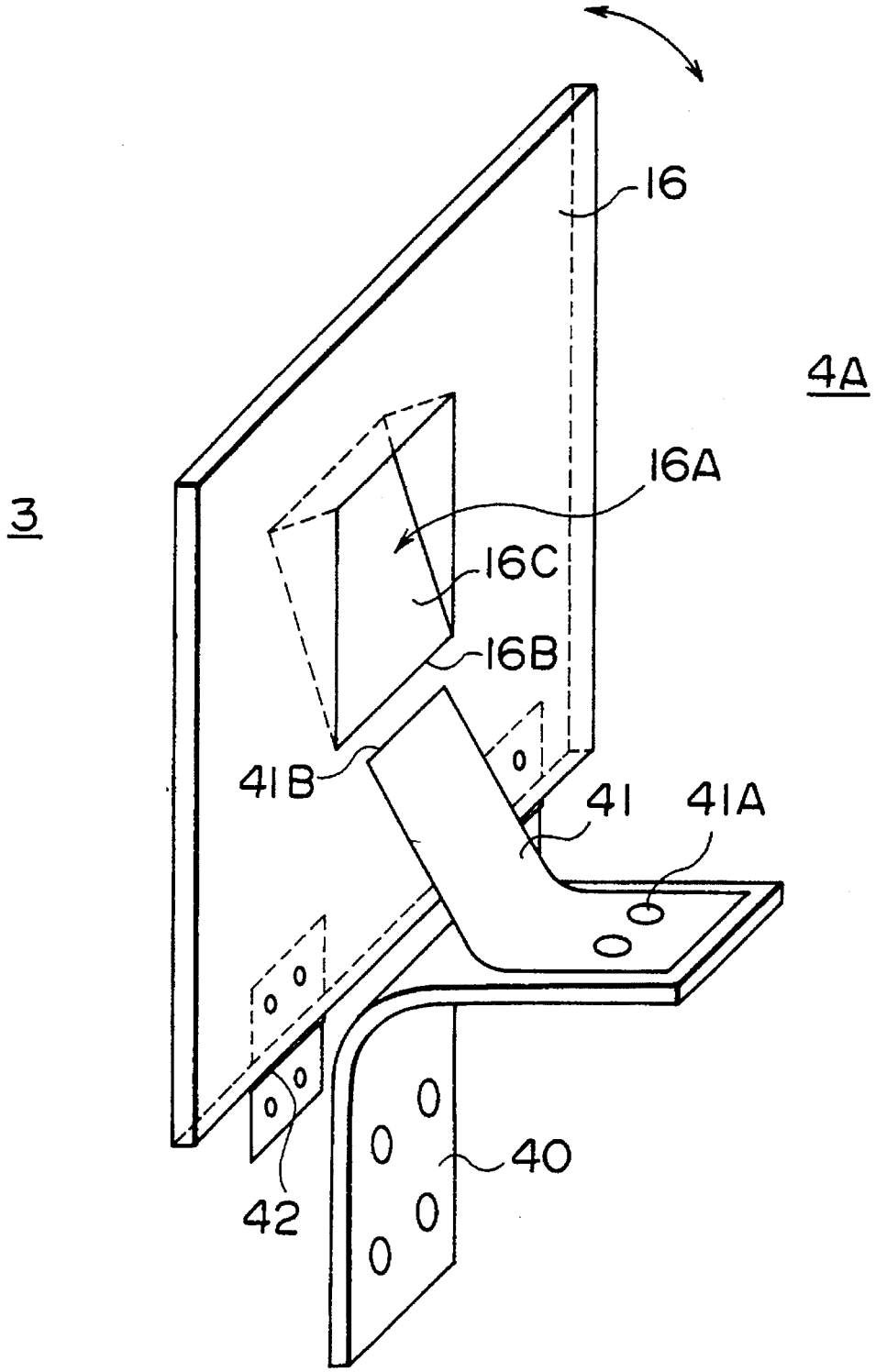
FIG. 13 is a perspective view of a valve according to the ninth embodiment of this invention.
Figure 14:
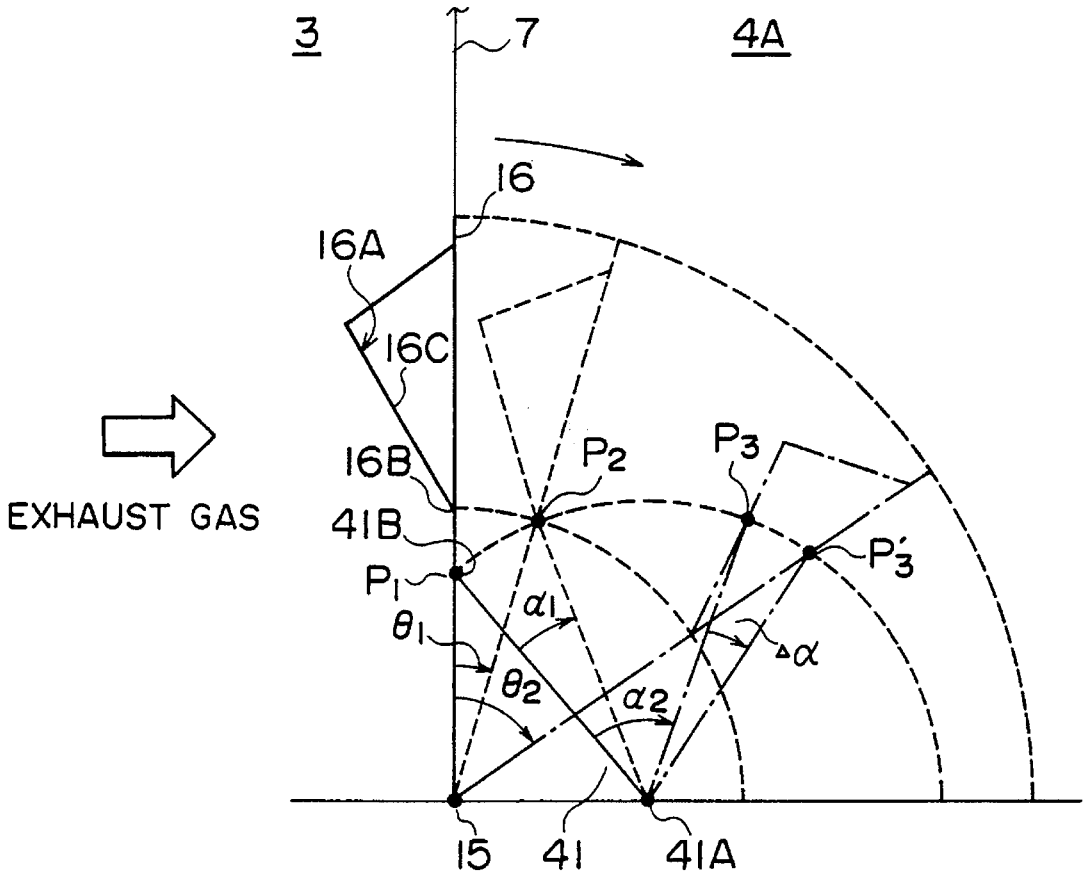
FIG. 14 is a diagram showing a relation between a valve opening angle and spring support position according to the ninth embodiment of this invention.

FIGS. 12–14 shows a ninth embodiment of this invention. This embodiment relates to the means used to push the valve 16. The structure of the muffler 1 is the same as that of the third embodiment.

The valve 16 opens and closes the opening 14 formed in the baffle plate 7. One edge of the valve 16 is hinged on an axis 42 in the baffle plate 7. The valve 16 is thereby supported free to pivot in the chamber 4A.

The valve 16 has a hollow 16A in its rear surface. The valve 16 is pushed towards the closed position by a spring 41 installed in the chamber 4A. The spring 41 is a plate spring having a predetermined spring constant. As shown in FIG. 13, a base 41A of the spring 41 is fixed to an L-shaped bracket 40 fixed to the baffle plate 7 in the vicinity of the shaft 42. The spring 41 is bent in the direction of the hollow 16A in its middle region, its free end 41B being in contact with the rear surface of the valve 16.

The distance between the base 41A and the shaft 42 is set at a predetermined value. The spring 41 deforms according to the increase of opening angle of the valve 16, and the load applied to the valve 16 in the direction tending to close it is thereby increased.

The hollow 16A has a triangular longitudinal section and a width sufficient to allow penetration of the free end 41B of the spring 41. The hollow 16A has a slanting surface 16C that inclines toward the interior of the valve 16 at a predetermined angle from its leading edge 16B.

In the low engine speed region, the valve 16 does not open, and exhaust gas in the chamber 3 is discharged only from the tail tube 12A as in the case of the other embodiments.

When the engine speed increases, the pressure of the exhaust flowing in from the inlet tube 9 rises, the valve 16 opens against the force of the spring 41, and a part of the exhaust gas flows into the chamber 4A. As the exhaust pressure rises the valve 16 opens wide, but the free end 41B of the spring 41 then slides into the hollow 16A along the slanting surface 16C from the rear side of the baffle plate 7.

The relation between the opening angle of the valve 16 and the position of the free end 41B of the spring 41 is as shown in FIG. 14. $P_1$ in the figure shows the position of the free end 41B of the spring 41 when the valve 16 is closed.

In the position where the valve 16 has opened to an angle $\theta_1$, the spring 41 bends by an angle $\alpha_1$ from its initial position so that its free end 41B reaches $P_2$, i.e. the leading edge 16B of the hollow 16A.

When the exhaust pressure increases further and the opening angle of the valve 16 increases, the free end 41B slides into the hollow 16A along the slanting surface 16C.

When the opening angle of the valve 16 reaches $\theta_2$, the free end 41B reaches $P_3$, and the bending angle of the spring 41 is $\alpha_2$ from its initial position.

If the rear surface of the valve 16 is flat shaped, the position of the free end 41B for the same opening angle $\theta_2$ is $P_3'$, and the bending angle of the spring 41 is a value $\alpha_2+\Delta\alpha$. The load exerted by the spring 41 on the valve 16 increases according to the bending angle, so if the hollow 16A were not provided, the load acting on the valve 16 would increase by an amount corresponding to the bending angle $\Delta\alpha$. In other words, by providing the hollow 16A, the spring load is reduced by an amount corresponding to the bending angle $\Delta\alpha$.

In other words, according to this embodiment, in the region between the positions $P_1$ and $P_2$ of the free end 41B of the spring 41, the spring load increases at a first rate according to the opening angle of the valve 16, and when the free end 41B is displaced beyond $P_2$, the spring load increases at a second rate that is less than the first rate of increase.

The rate of increase of resistance offered by the valve 16 to the exhaust varies according to this spring load. The rate of increase of resistance when the valve 16 opens to an angle greater than $\theta_1$ is thereby reduced, energy loss due to increase of negative pressure in the high engine speed region is kept small, and drop of engine power is reduced.

Figure 15:
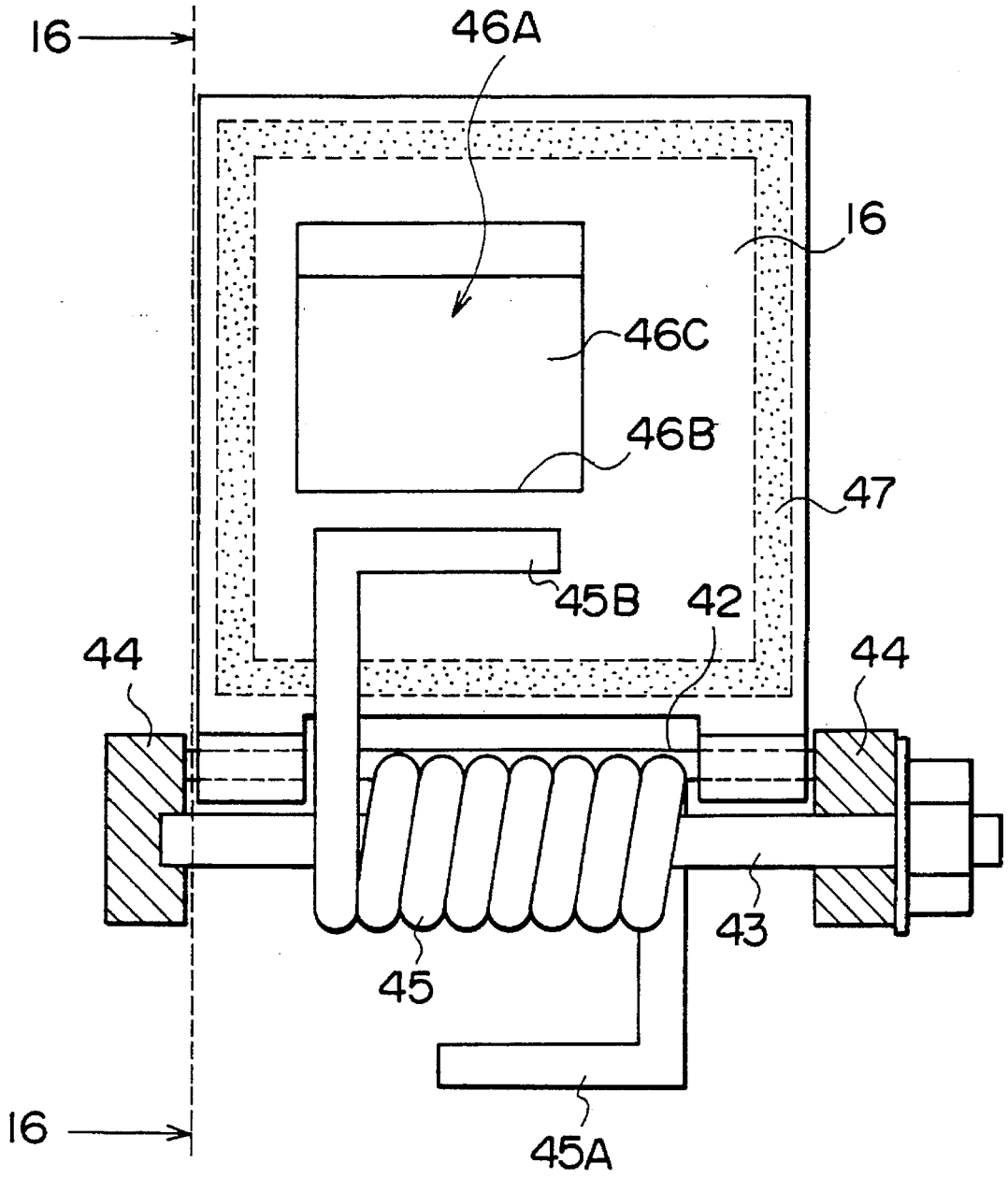
FIG. 15 is a rear view of a valve according to a tenth embodiment of this invention.
Figure 16:
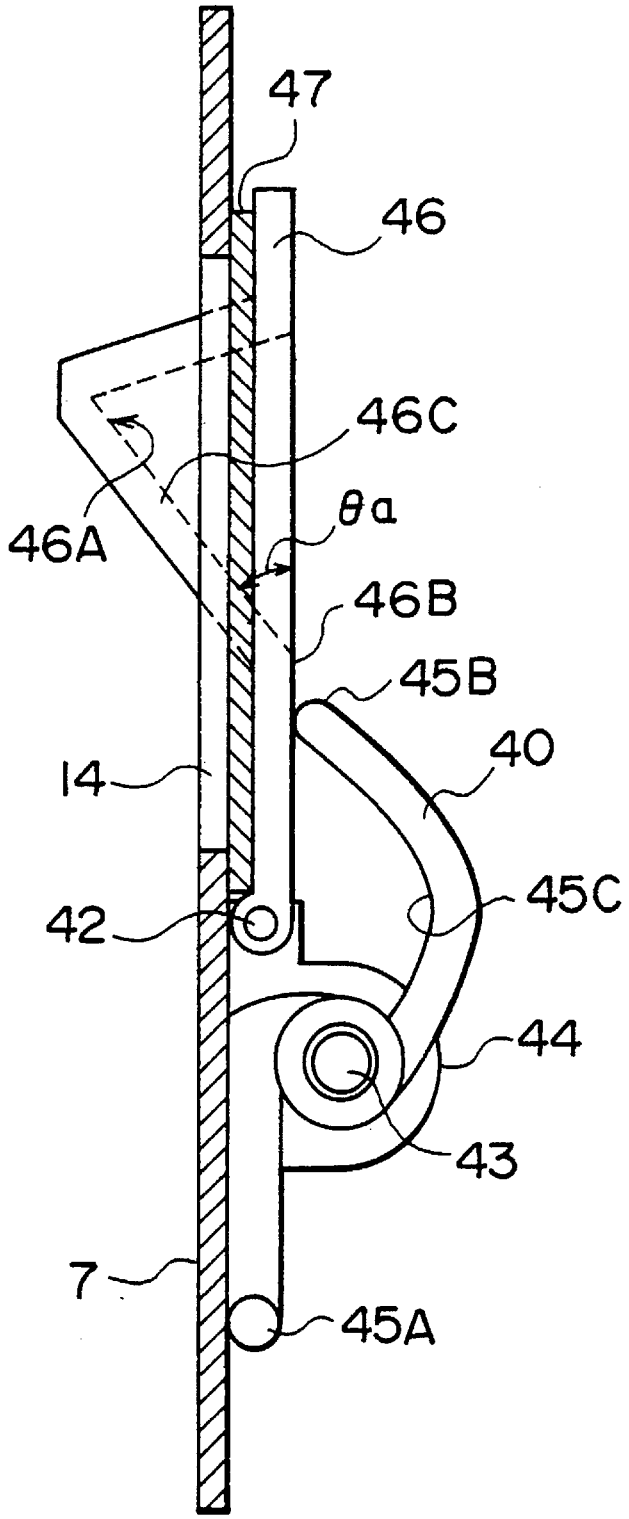
FIG. 16 is a cross-sectional view of the valve taken along a line 16—16 of FIG. 15.
Figure 17:
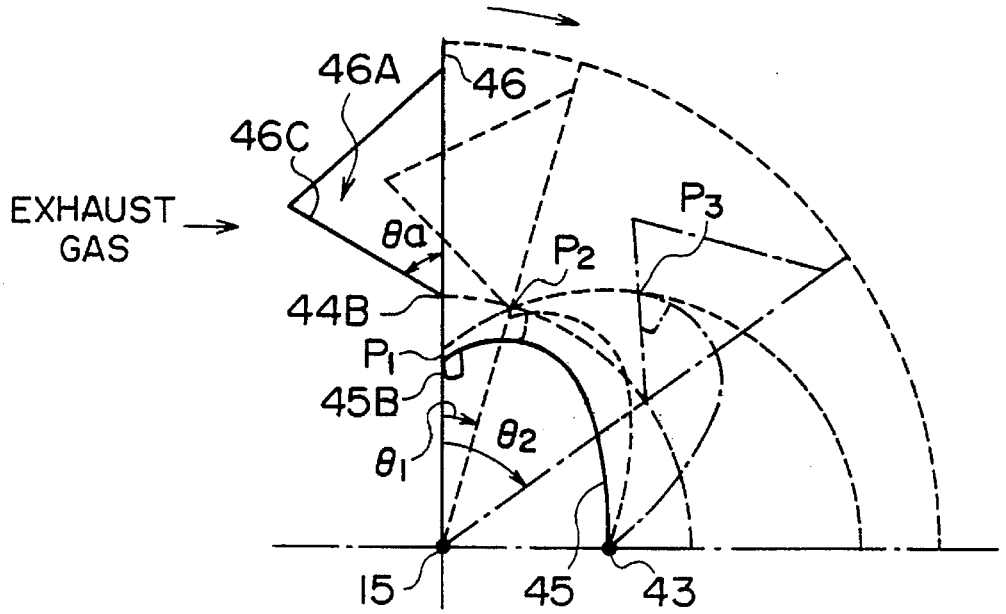
FIG. 17 is a diagram showing a relation between a valve opening angle and spring support position according to the tenth embodiment of this invention.

FIGS. 15–17 show a tenth embodiment of this invention. According to this embodiment, the spring 41 of the ninth embodiment is replaced by a coil spring 45. The valve 16 is replaced by a valve 45 having a hollow 46A with a larger slant angle than that of the hollow 16A. A shock absorbing material 47 is also interposed between the valve 46 and baffle plate 7.

The spring 45 is fitted on a shaft 43 that is horizontally supported in a position at a predetermined distance from a shah 42. The two ends of the shafts 42 and 43 are supported by two bearings 44 fixed to the baffle plate 7.

The base 45A of the spring is in contact with the baffle plate 7. The free end 45B of the spring 45 has a bent part 45C that is bent toward the valve 46 so that positions other than the free end 45B of the spring 45 do not interfere with the valve 46 when the valve 46 opens.

When the engine speed rises and the exhaust pressure increases, the valve 46 opens. According also to this embodiment, until the free end 45B reaches the leading edge 46B of the hollow 46A, i.e. during the interval from $P_1$ to $P_2$ in FIG. 17, the load of the spring 45 increases at a first rate, and during the interval beyond $P_2$, it increases at a second rate less than the first rate. According also to this embodiment, therefore, as in the case of the ninth embodiment, power drop in the high engine speed region is suppressed.

According to this embodiment, the slant angle θa of the slanting surface 46C of the hollow 46 is made large. The second rate of increase is therefore even less than in the ninth embodiment, and the drop of power in the high engine speed region is still smaller. In other words, the valve closing force in the low speed region may be increased.

The shock absorbing material 47 interposed between the baffle plate 7 and valve 46 absorbs the shock when the valve shuts, and enhances sealing against leak of exhaust from the valve 46 in the low speed region.

Figure 18:
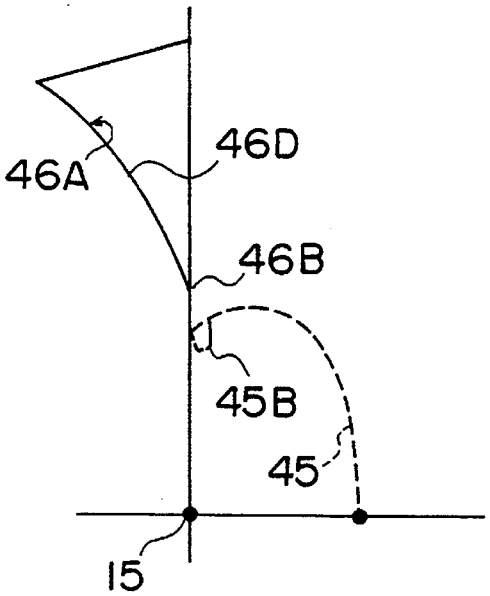
FIG. 18 is similar to FIG. 17, but showing an eleventh embodiment of this invention.

FIG. 18 shows an eleventh embodiment of this invention. In this case, a curved surface 46D is formed instead of the slanting surface 46C of the hollow 46A. The rate of increase of load when the valve 46 opens beyond the point $P_2$ in the figure, i.e. the second rate of increase, therefore decreases with increase of opening angle. As a result, the suppression of power drop in the high speed region is still further enhanced, the variation of spring constant is smooth, and the opening and closing of the valve 46 is smooth.

Figure 19:
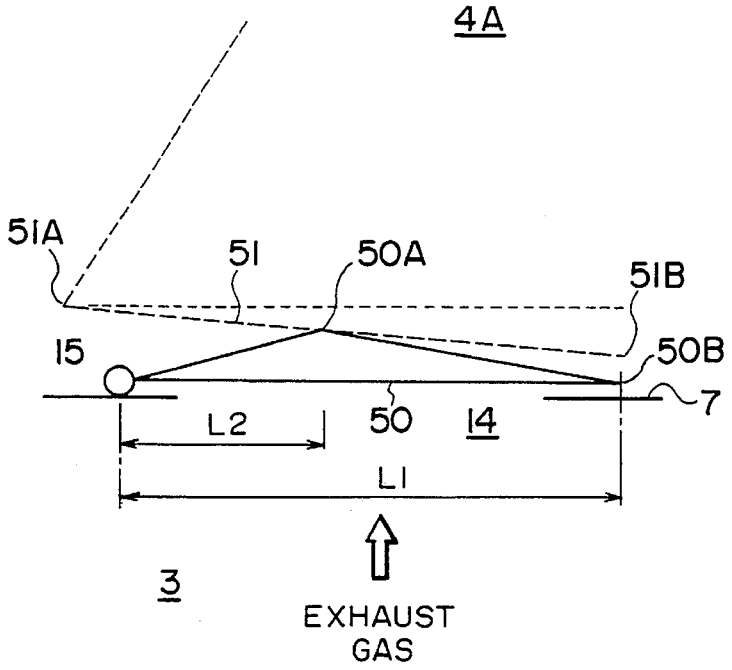
FIG. 19 is a schematic diagram of a valve according to a twelfth embodiment of this invention.
Figure 20:
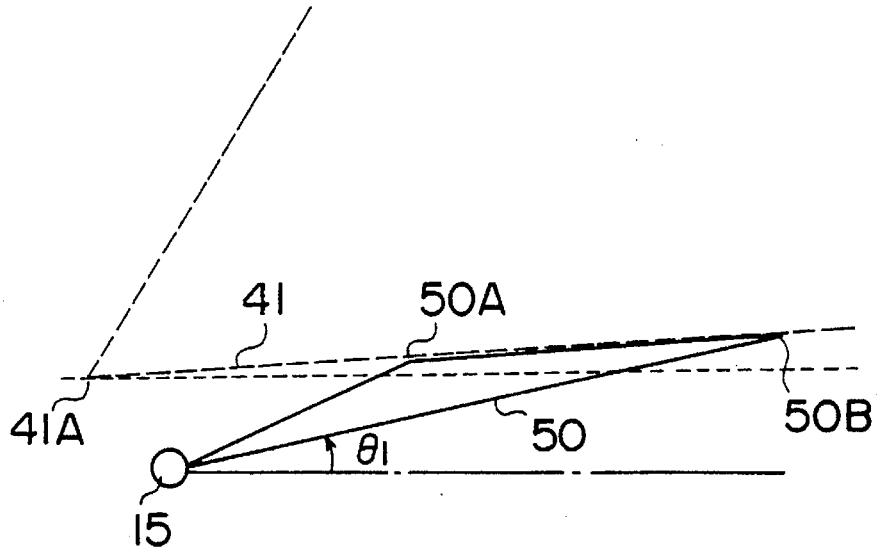
FIG. 20 is similar to FIG. 19, but showing the valve at an opening angle $\theta_1$.
Figure 21:
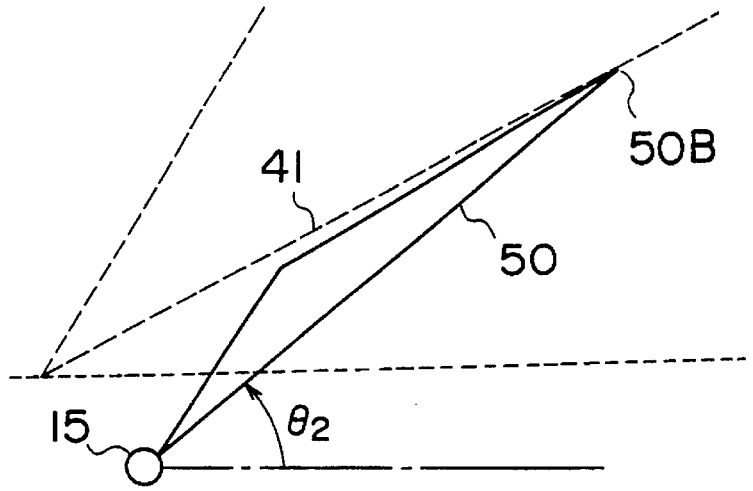
FIG. 21 is similar to FIG. 19, but showing the valve at an opening angle $\theta_2$.

FIGS. 19–21 show a twelfth embodiment of this invention. Instead of the valve 16 having the hollow 16A of the ninth embodiment, a valve 50 having a projection 50A as shown in FIG. 19 is provided.

When the valve 50 has an opening angle up to a value of $\theta_1$ as shown in FIG. 20, the spring 41 is in contact with the projection 50A. However, when the opening angle increases beyond $\theta_1$, as shown in FIG. 21, the spring 41 comes into contact with the tip 50B of the valve 50. In other words, the action point of the spring load shifts from a distance $L_2$ to a distance $L_1$ away from the shaft 15 at a threshold angle of $\theta_1$, hence above this angle $\theta_1$, the moment exerted by the exhaust pressure on the spring 41 sharply increases. Consequently, above the angle $\theta_1$, the load exerted by the spring 41 on the valve 50, i.e. the second rate of increase, is as small as in the case of the ninth embodiment.

Figure 23:
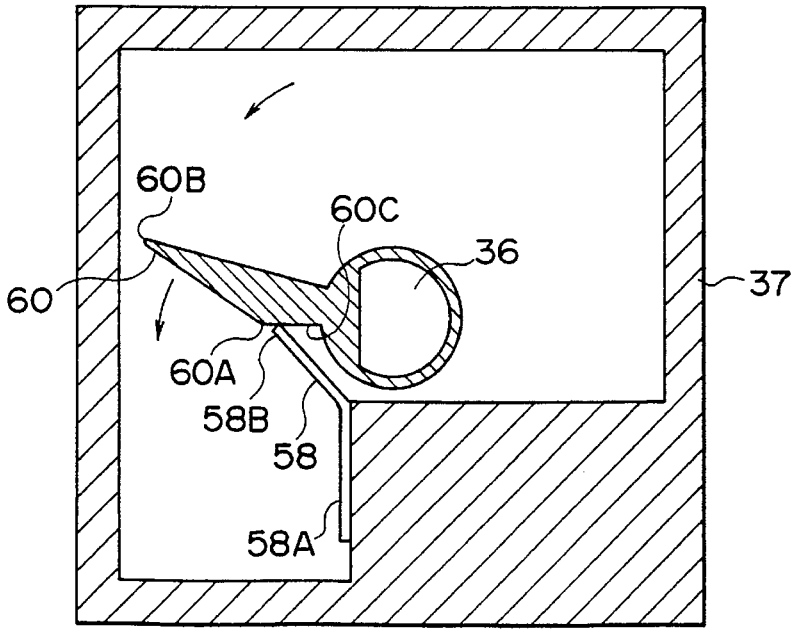
FIG. 23 is a cross-sectional view of a cam and spring according to the thirteenth embodiment of this invention, taken along a line 23—23 in FIG. 22.
Figure 22:
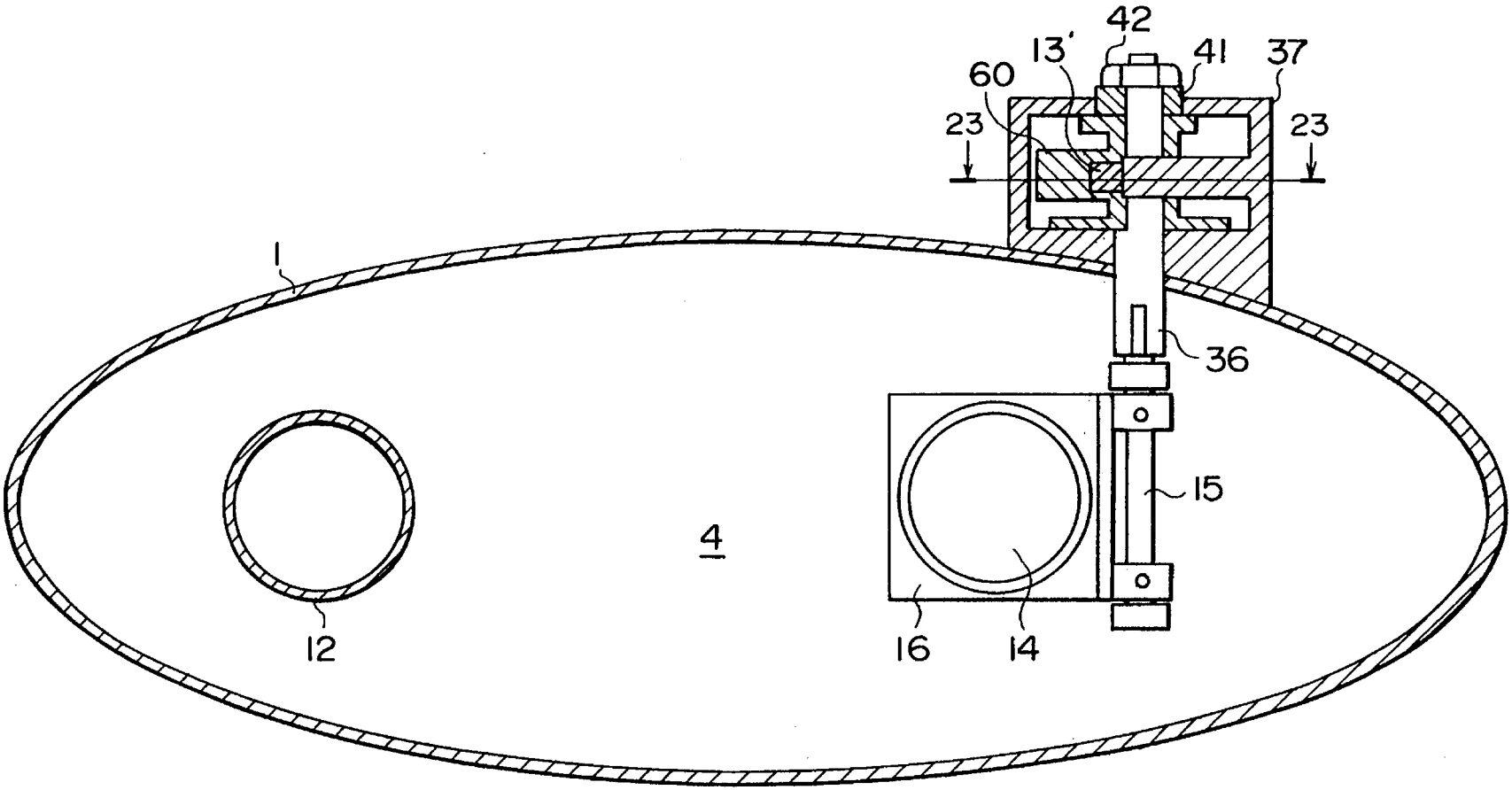
FIG. 22 is similar to FIG. 2, but showing a thirteenth embodiment of this invention.

FIGS. 22 and 23 show a thirteenth embodiment of this invention. According to this embodiment, a cam 60 of different diameter fits over the shaft 36 of the eighth embodiment as shown in FIG. 22, and the cam 60 is pushed by a spring 58 in a direction tending to close the valve 16. The cam 60 is provided with a projection 60A between a base 60C that is near the shaft 36 and a free end 60B. The cam 60 therefore gradually increases in width from the base 60C to the projection 60A, and gradually becomes thinner from the projection 60A to the free end 60B.

A base 58A of the spring 58 is fixed to the case 37, and after bending in the middle, the free end 58B comes into contact with the cam 60.

The cam 60 turns in the direction of the arrow in FIG. 23 as the valve 16 opens. As the valve 16 opens to a predetermined angle from the closed position, the free end 58B slides on a first sliding surface between the base 60C and the projection 60A, and at greater opening angles, the free end 58B slides on a second sliding surface between the projection 60A and the free end 60B. The angle subtended by the second sliding surface at the spring 58 is less than the angle subtended by the first sliding surface at the spring 58, hence the increase of bending angle of the spring 58 per unit rotation of the cam 60 is less for the second sliding surface. Therefore, when the contact point of the free end 58B and the cam 60 shifts from the first sliding surface to the second sliding surface due to rotation of the cam 60, the rate of increase of load exerted by the spring 58 on the cam 60 is reduced. In other words, in the high engine speed region when the valve 16 is wide open, the rate of increase of load exerted by the spring 58 due to rotation of the cam 60 becomes less. Exhaust resistance in the high speed region is therefore reduced and power loss is suppressed, as in the case of the ninth to the twelfth embodiments.

Figure 24:
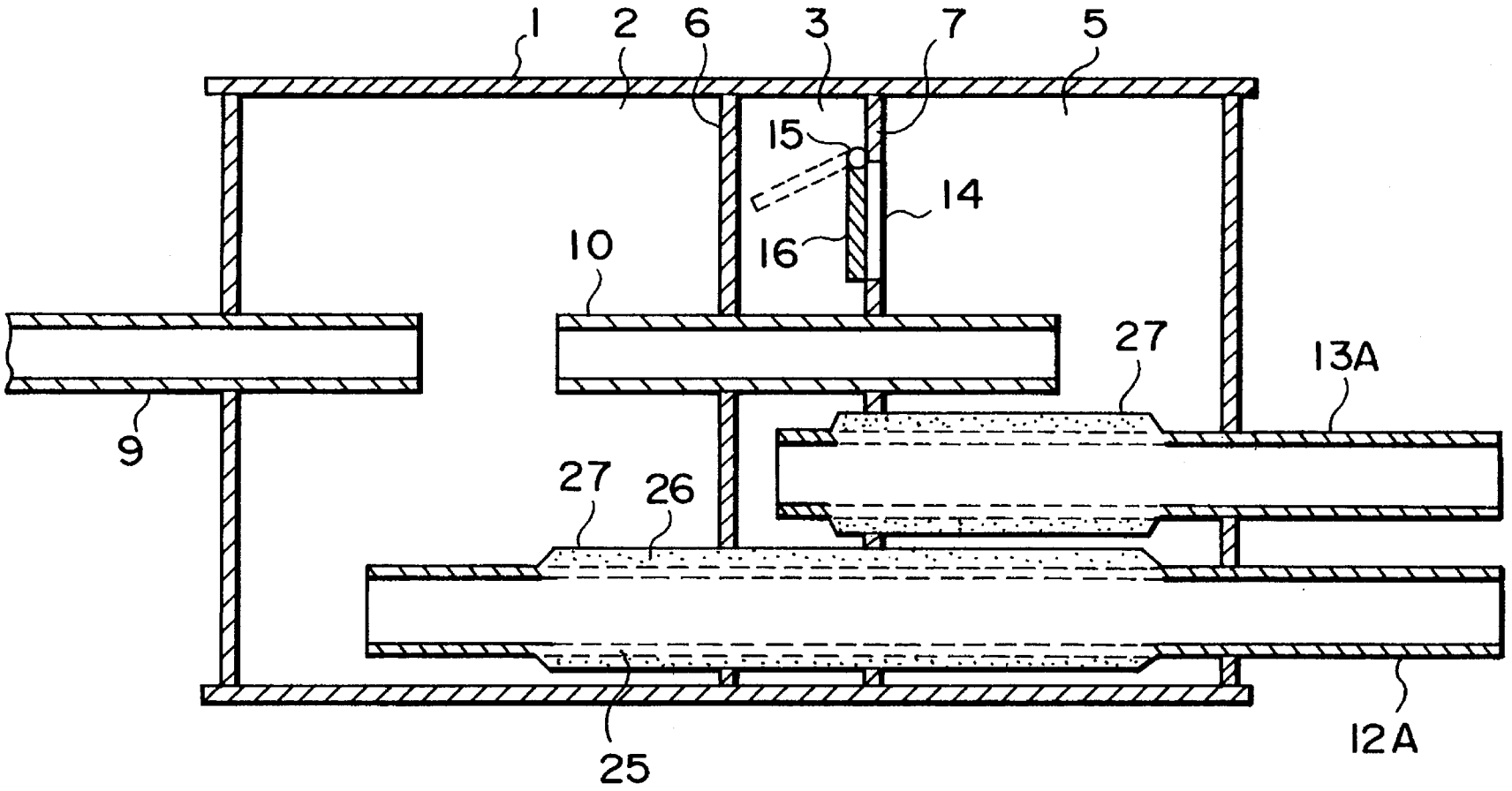
FIG. 24 is similar to FIG. 1, but showing a fourteenth embodiment of this invention.

FIG. 24 shows a fourteenth embodiment of this invention. Herein, the muffler 1 is partitioned into chambers 2, 3 and 5 by means of baffle plates 6 and 7.

The inlet tube a opens in the chamber 2 which is connected to the chamber 5 via the tube 10 that passes through the chamber 3. The valve 16, which opens and closes the opening 14 formed in the baffle plate 7 according to the pressure in the chamber 5, is provided on the baffle plate 7. Valve 16 may be constructed, for example, with any of the alternative valve structures described with respect to FIGS. 2–4 and/or FIGS. 13–23. Also, a reed valve, as described with respect to FIG. 5, may be used instead of the valve 16.

One end of the tail tube 12A is open to the chamber 2 while one end of the tail tube 13A is open to the chamber 3. A large number of holes 25 are formed in those parts of the tail tubes 12A, 13A situated in the chambers 2, 3, and 5. Sound absorbing material 26 is wound around the outer circumference of the tubes. The outer circumference of this material 26 is moreover covered by an envelope 27 to prevent exhaust from leaking from the tail tubes 12A, 13A.

In this embodiment, the tube 10 and chamber 5 forms a resonating chamber which increases attenuation of low frequency components of the exhaust noise.

The embodiments of this invention in which an exclusive property or privilege is claimed are defined as follows:

We claim:

1. An exhaust noise suppressor for suppressing exhaust noise in an automobile engine, comprising:

a muffler, said muffler being partitioned into a first chamber, a second chamber, and a third chamber by means of a first baffle plate and a second baffle plate, respectively, wherein said first chamber is connected to said third chamber via an internal tube, and wherein said third chamber is connected to said second chamber via a passage;

an inlet tube opening into the first chamber;

a valve for opening and closing said passage according to an engine exhaust pressure in the third chamber;

a first discharge pipe for discharging exhaust from said first chamber; and a second discharge pipe for discharging exhaust from said second chamber, wherein the internal tube and the third chamber reduce exhaust noise in a low engine speed region.

2. An exhaust noise suppressor as recited in claim 1, wherein said first and second discharge pipes comprise a plurality of holes connecting the inside and outside of said pipes, a sound absorbing material covering said holes, and an envelope covering said sound absorbing material for preventing exhaust gas from leaking to the outside of said pipes.

3. An exhaust noise suppressor as recited in claim 1, wherein said valve comprises a reed valve.

* * * * *